US010336421B2

(12) United States Patent
Bianchi

(10) Patent No.: US 10,336,421 B2
(45) Date of Patent: Jul. 2, 2019

(54) PROPELLER AND RELATIVE METHOD FOR FINE ADJUSTING THE FLUID DYNAMIC PITCH OF THE PROPELLER BLADES

(71) Applicant: MAX PROP S.r.l., Milan (IT)

(72) Inventor: Massimiliano Bianchi, Milan (IT)

(73) Assignee: MAX PROP S.R.L., Milan (IT)

( * ) Notice: Subject to any disclaimer, the term of this patent is extended or adjusted under 35 U.S.C. 154(b) by 126 days.

(21) Appl. No.: 14/758,145

(22) PCT Filed: Dec. 27, 2012

(86) PCT No.: PCT/IB2012/002956
§ 371 (c)(1),
(2) Date: Jun. 26, 2015

(87) PCT Pub. No.: WO2014/102559
PCT Pub. Date: Jul. 3, 2014

(65) Prior Publication Data

US 2015/0329187 A1 Nov. 19, 2015

(51) Int. Cl.
*B63H 3/00* (2006.01)

(52) U.S. Cl.
CPC ..... *B63H 3/00* (2013.01); *B63H 3/008* (2013.01)

(58) Field of Classification Search
USPC ..... 411/190, 120, 925, 926; 74/10.2, 827
See application file for complete search history.

(56) References Cited

U.S. PATENT DOCUMENTS 564,289 A * 7/1896 Maloney ..... F16B 39/06
411/322
697,316 A * 4/1902 Boykin ..... F16B 39/06
411/321

(Continued)

FOREIGN PATENT DOCUMENTS

DE 3901672 8/1990
DE 4034587 5/1992

(Continued)

OTHER PUBLICATIONS

Machine Translation of IDS Reference Huebner DE 4034587 (A1).*
International Search Report issued in PCT Application No. PCT/IB2012/002956.

*Primary Examiner* — Jason D Shanske
*Assistant Examiner* — Brian Christopher Delrue
(74) *Attorney, Agent, or Firm* — Lucas & Mercanti, LLP

(57) ABSTRACT

A propeller and related method for adjusting the fluid-dynamic pitch of the propeller blades are described. The propeller has at least one rotatable blade pivoted to a propeller cylindrical casing, a hub adapted to be coupled to an engine and mounted within the propeller casing. The hub is rotatable with respect to the propeller cylindrical casing, or vice versa, for a non-zero angular interval (α) for the adjustment of the fluid-dynamic blade pitch. Moreover, the hub has a contact surface movable between direct or indirect disengagement and engagement positions with a respective abutment which defines a limit stop of the angular interval (α). The limit stop abutment has a region of a movable element arranged in a seat of the propeller cylindrical casing for modifying the limit stop abutment position of the at least one angular interval (α).

14 Claims, 3 Drawing Sheets

(56) References Cited

U.S. PATENT DOCUMENTS 916,997 A * 4/1909 Chadwick ..... F16B 39/10 411/120
922,642 A * 5/1909 Twyman ..... F16B 39/10 411/120
1,070,946 A * 8/1913 Davis ..... F16B 39/10 411/120
1,077,670 A * 11/1913 Church ..... F16B 39/10 411/221
1,088,515 A * 2/1914 Bazin ..... F16B 39/10 411/120
1,090,943 A * 3/1914 Howe ..... F16B 39/10 411/120
1,229,783 A * 6/1917 Pogue ..... F16B 39/10 403/148
1,799,950 A * 4/1931 Boyd ..... B26B 13/28 30/270
1,981,705 A * 11/1934 Morris ..... G05D 23/02 188/196 R
2,108,032 A * 2/1938 Allen ..... B25D 17/08 279/19
2,181,301 A * 11/1939 Geddes ..... F16B 39/10 411/119
2,203,219 A * 6/1940 Jackman, Jr. ..... F16B 39/06 411/227
3,351,364 A * 11/1967 Warn ..... F16D 11/14 192/69.43
3,385,137 A * 5/1968 Barden ..... B21D 43/14 74/822
3,477,305 A * 11/1969 McCartin ..... F16H 27/045 74/415
3,726,570 A * 4/1973 Wetherill ..... B62D 55/28 305/187
4,028,966 A * 6/1977 Taylor ..... B23Q 16/06 74/813 C
4,118,007 A * 10/1978 Scapes ..... F16K 27/00 251/223
5,326,223 A * 7/1994 Speer ..... B63H 3/04 416/136
5,554,003 A * 9/1996 Hall ..... B63H 3/008 416/131
6,758,646 B1 * 7/2004 Ishida ..... F16B 39/028 411/119
7,922,433 B2 * 4/2011 Ricciardo ..... F16B 39/10 411/119
8,052,225 B2 * 11/2011 Inoue ..... B62K 23/06 280/279
8,702,351 B2 * 4/2014 Gamble ..... B23B 31/1076 407/40
9,272,574 B2 * 3/2016 Ebert ..... B60B 27/0078
9,279,458 B2 * 3/2016 Nixon ..... H02K 1/30
9,468,481 B2 * 10/2016 Klein ..... A61B 17/8047
9,533,745 B2 * 1/2017 Bianchi ..... B63H 3/008
2003/0190212 A1 * 10/2003 Peterkort ..... F16B 41/002 411/119
2005/0175430 A1 * 8/2005 Madden, III ..... F16B 43/00 411/119
2006/0188357 A1 * 8/2006 Rowe ..... F16B 37/044 411/119
2008/0279652 A1 * 11/2008 Mielke ..... F16B 33/002 411/109
2011/0194913 A1 * 8/2011 Lewis ..... F01M 11/0408 411/432
2012/0141199 A1 * 6/2012 Anderson, III ..... F16D 1/05 403/370
2012/0230798 A1 * 9/2012 Sterle ..... F16B 39/028 411/120
2014/0301843 A1 * 10/2014 Bianchi ..... B63H 3/008 416/107

FOREIGN PATENT DOCUMENTS

IT 1052002 6/1981
WO 2008/075187 6/2008
WO 2013/011338 1/2013

* cited by examiner

PROPELLER AND RELATIVE METHOD FOR FINE ADJUSTING THE FLUID DYNAMIC PITCH OF THE PROPELLER BLADES

CROSS-REFERENCE TO RELATED APPLICATIONS

This application is a 371 of PCT/IB2012/002956, filed Dec. 27, 2012.

FIELD OF THE INVENTION

The present invention relates to a propeller, preferably for marine use, and a related method, for the adjustment of the fluid-dynamic pitch of the propeller blades.

PRIOR KNOWN ART

It is known that the arrangement of the propeller blades with a correct and suitable angle of incidence with respect to the fluid that hits the blades, i.e. a correct fluid-dynamic pitch, allows, also depending on the conditions of use and of the torque delivered by the engine of the boat to which the propeller is coupled, to maintain a high efficiency and satisfactory performance of the propeller itself.

IT1052002, in the name of Massimiliano Bianchi, instructs on how to obtain a propeller, in particular for use in sailing boats provided with an auxiliary engine, wherein the drive shaft (or the related propeller hub) and the propeller casing are mutually coupled by way of two teeth coplanar to the axis of the propeller itself.

At propeller stopped, the blades are arranged at feathered position so as to generate minimum resistance, and the teeth of the hub and the propeller casing are mutually spaced so that the subsequent rotational actuation of the drive shaft and hence of the hub, both in one direction, and in the other, causes its idle rotation by a certain angular interval, to which corresponds the rotation of the blades with respect to the cylindrical casing, thanks to a suitable pinion and gear wheel kinematic mechanism.

When the hub reaches the abutment position against the propeller casing, and their relative rotation is inhibited, the blades are arranged on a predetermined fluid-dynamic pitch, that will depend on the angle of relative rotation between the hub and the propeller casing, and vice versa.

In doing so the propeller blades can reach a first pitch, and therefore a certain incidence angle, adapted to the forward movement of the boat and a second pitch, adapted to the reverse movement of the boat, depending on the rotation direction of the drive shaft relative to the propeller casing.

However, with a propeller of the type just described the fluid-dynamic pitch or the interval of the fluid-dynamic pitches, of the propeller established during its design cannot be easily changed.

In fact, once the most appropriate blade pitch is established in the design step for forward movement and the most appropriate one for the boat reverse movement, it is no longer possible for the operator to easily vary this rotation angle.

The modification of the propeller pitch in this case may be achieved only by disassembling the propeller and intervening on the inside with the replacement of the hub or the propeller casing, or by subjecting such items to mechanical machining.

Only by performing such operations, the relative rotation of the hub with respect to the propeller casing brings the blades to be arranged on the desired pitch depending on the needs of both installation and use. Obviously the propeller user is not able to autonomously carry out the disassembly and the replacement of the propeller or the mechanical processing of its parts, and for this reason it is necessary the intervention of a skilled operator or the sending of the propeller to the manufacturer.

To overcome these drawbacks, propellers have been developed wherein the relative rotation angle of the hub with respect to the propeller casing, and vice versa, which results in a rotation of the blades around their pivoting axis with respect to the propeller casing by way of an appropriate kinematic mechanism, can be changed by the user by acting on threaded grub screws which are screwed in suitable seats with which the propeller is provided, so as to protrude inside the propeller casing to determine a modification of the relative rotation angle between the hub and the propeller casing.

A propeller of this type is described in DE3901672, wherein the hub has a tooth destined to come into contact with two corresponding stop abutments with which the propeller cylindrical casing is provided upon idle rotation, for an angular interval of rotation between the propeller casing and the hub, which determines the achievement of the predetermined fluid-dynamic blade pitch.

The propeller casing is provided with two threaded seats inside which two grub screws are screwed which are intended to protrude inside the propeller casing and on which the hub tooth is intended to reach the abutment position. It follows that the ends of the grub screws protruding within the propeller casing constitute the aforementioned stop abutments (or limit stop) for the tooth of the hub.

The relative rotation of the hub with respect to the propeller casing, and the fluid-dynamic blade pitch that is set accordingly, are modified by the boat user by screwing or unscrewing the grub screws so that the portion thereof that is protruding inside the propeller casing is increased or decreased, thereby obtaining a corresponding change in the abutment position with the hub tooth, and thus a consequent modification of the angular interval of rotation of the hub with respect to the propeller casing, and vice versa.

However, this type of propeller has some drawbacks arising from the fact that the adjustment of the blade pitch is obtainable in a non-accurate way and substantially related to the ability and precision of the boat user when screwing or unscrewing the grub screws in corresponding threaded seats for a certain number of turns, or fractions of a turn, adapted to achieve the desired pitch.

In fact, when the boat user wants to change the blade pitch it will be necessary to manually act on the grub screws, screwing or unscrewing these latter within the threaded holes.

Obviously, said adjustment results not very precise and errors are not uncommon by the user in the regulation of the grub screws, which result in a wrong positioning of the blades on a fluid-dynamic pitch different from that desired. In fact, as already said, the user must cause a rotation of the grub screws in a clockwise or counterclockwise direction, for a certain number of turns, or fractions of a turn.

To this is added the significant complication due to the fact that said grub screws adjustment operations are generally carried out under immersion below the water surface.

It is clear that such a procedure requires numerous attempts, in which the user is obliged to submerge under water and try different adjustments by tightening or loosening the grub screws.

It has also to be noted that in the case where the new fluid-dynamic pitch set is not satisfactory in terms of efficiency and performance compared to the one previously set, the user must try to remember in which direction and to which rotation had actuated the grub screws trying to bring them in the previous position, in order to re-establish the fluid-dynamic pitch previously set.

Therefore, it becomes necessary to simplify the adjustment operations described above, reducing the number of attempts that the user of the boat must perform to achieve the desired fluid-dynamic pitch.

In a recent patent application, also in the name of the Applicant, a propeller is described wherein the pitch adjustment is carried out by way of a plurality of calibrated screws having a predetermined length. To the length of each screw corresponds a pre-determined fluid-dynamic blade pitch reachable by way of the modification of the angle of relative rotation of the hub with respect to the propeller casing, or vice versa. The propeller is provided with a number of screws of different lengths which can be substituted for the pitch modification by a well-defined and predetermined quantity.

A propeller of this type, while allowing the achievement of a well-defined fluid-dynamic pitch, depending on the length of the screw installed, suffers the drawback of having to be accompanied by a number of screws sufficiently high in the case wherein is needed to make a fine and accurate pitch adjustment.

In fact, nowadays, the new technologies require pitch adjustments ever more accurate in order to obtain high efficiency during sailing. Therefore, with the propeller of the type described above a high number of screws should be provided, and especially each screw should have an extremely precise calibrated length with high production costs.

It is therefore object of the present invention to overcome the problems of the prior art briefly discussed above, and to make available a propeller and the related adjustment method of the fluid-dynamic blade pitch that is simple to implement and that, above all, ensures the reliable and accurate achievement of the desired fluid-dynamic pitch.

It is also object of the present invention to make available a propeller and a method of adjusting the fluid-dynamic pitch thanks to which the boat user can position the blades on different fluid-dynamic pitches without having to make numerous adjustment attempts.

SUMMARY OF THE INVENTION

These and other objects are achieved by a propeller, and the related use method, respectively according to the independent claims 1 and 12.

The propeller according to the present invention comprises at least one propeller cylindrical casing, a hub, that can be coupled to an engine and mounted inside the propeller cylindrical casing, and at least one blade pivoted rotatably to the propeller cylindrical casing. The hub is rotatable with respect to the propeller cylindrical casing, or vice versa, for at least one non-zero angular interval ($\alpha$) for the adjustment of the fluid-dynamic pitch of said at least one blade, and the hub further comprises at least one contact surface movable between at least one direct or indirect disengagement position and at least one direct or indirect engagement position with at least one relative abutment which defines at least one limit stop of the angular interval ($\alpha$).

The limit stop abutment comprises at least one region of at least one movable element placed in at least one seat of the propeller cylindrical casing for the modification of the position of the limit stop abutment of the angular interval ($\alpha$). The propeller is characterized by comprising means for adjusting the position of the at least one movable element, in one or more discrete intervals, for the modification of the position of the at least one limit stop abutment of the angular interval ($\alpha$).

Advantageously, the propeller according to the present invention allows to change the position of the movable element and therefore that of the limit stop abutment of the angular interval in a fine and accurate way, as well as being quick and simple.

In fact, the means for adjusting the position determine the change in the position of the movable element in one or more discrete intervals, allowing to obtain a consequent modification of the fluid-dynamic pitch by very accurate predetermined and discrete values.

In fact, the means for adjusting the position of the at least one movable element in one or more discrete intervals define two or more positions of the limit stop abutment of the angular interval ($\alpha$) of rotation of the hub with respect to the propeller cylindrical casing, or vice versa.

On the contrary, in the propellers of the type described for example in the application DE3901672, the pitch adjustment is inaccurate as determined solely by the rotation imposed by the user to grub screws that are installed in the corresponding seats with which the propeller is provided. Obviously the rotation imposed by the user, although it could in theory ensure a fine adjustment pitch, is, however, inaccurate as solely defined by the position of the grub screw, installed inside the seat, uncertain and difficult to define and re-obtain. Advantageously, in the propeller according to the present invention, the movable element or elements constitute the abutment for the hub so that the limit stop of the angular interval can be easily modified by the user simply by changing the position of the movable element.

Furthermore, the means for adjusting the position of the movable element with respect to the propeller cylindrical casing modify the position of the limit stop abutment of the angular interval $\alpha$. In particular, the adjustment means with which the propeller is provided allow to obtain a modification of the discrete intervals type, in other words, it is possible to change the position of the movable element and therefore that of the limit stop abutment in predetermined distinct positions that allow to obtain very accurate and predetermined corresponding modifications of the pitch i.e. already known modifications.

According to one aspect of the present invention, the means for adjusting the position in one or more discrete intervals of the movable element comprise at least one blocking (block) element which engages at least partially with the movable element and at least partially with the propeller cylindrical casing, for retaining in a given position the movable element, corresponding to a determined fluid-dynamic pitch.

Furthermore, according to one aspect of the present invention the means for adjusting the position of the at least one movable element in one or more discrete intervals comprise at least one groove provided on at least part of the surface of the movable element.

In particular, the block element or elements of the adjustment means cooperate with the grooves in order to determine the change in the position of the movable element and therefore in the position of the limit stop abutment of the angular interval $\alpha$, according to one or more discrete intervals, and therefore according to different positions well defined and determined that correspond to predetermined changes in the fluid pitch.

Advantageously, the adjustment means comprise two or more grooves spaced from one another by one or more angular intervals (Ω) for the definition of one or more discrete intervals for adjusting the position of the movable element.

As will be clearer in the following, it is possible to divide the displacement of the movable element that determines different positions of the limit stop abutment, in one or more intervals, and then in more distinct positions defined by the grooves. The blocking element cooperates with the grooves by setting the movable element in the desired position.

In particular, according to one aspect of the present invention, the at least one blocking element engages at least partially with at least one groove of the movable element and at least partially with the propeller cylindrical casing. Preferably, the propeller casing comprises a seat which at least partially engages at least one blocking element.

According to a possible embodiment, the blocking element is substantially rod-shaped, and preferably comprises at least one threaded portion. In the latter case, a corresponding threaded portion is obtained in correspondence to the groove or grooves of the movable element and/or in correspondence to the propeller cylindrical casing, and in particular, in correspondence to the seat wherein the block element engages.

It should be noted that according to a preferred embodiment, the movable element has at least one threaded portion adapted to cooperate with at least one corresponding threaded portion of the seat in which it is installed.

As is known, imparting a rotation to the movable threaded element a consequent axial displacement will be obtained allowing the modification of the position of the limit stop abutment which, preferably, corresponds to the end of the movable element.

Advantageously, the presence of different grooves, spaced from each other by a given angular interval, allows to divide the rotation of the movable element in more discrete intervals which correspond to a division of the axial displacement of the movable element.

It follows that by rotating the movable threaded element for moving from one groove to another it is possible to change by a predetermined amount the axial displacement of the same, causing a corresponding change in the position of the limit stop abutment.

In particular, it is possible to divide the axial displacement of the movable element that determines different positions of the limit stop abutment on one or more intervals, dividing and adjusting the rotation of the movable element in corresponding positions defined by one or more discrete intervals.

In so doing the problems of the propellers known in the art are eliminated, such as that described in DE3901672, wherein the blade pitch is changed by executing several adjustment attempts of the grub screws.

According to one aspect of the present invention, the at least one threaded movable element is a screw comprising at least one shank. The threaded movable element comprises a clamping head which can reach a position of contact with at least one abutment portion of the cylindrical propeller casing seat wherein the movable element is installed.

It should be noted that according to one aspect of the adjustment method according to the present invention which will be described more in detail below, the movable threaded elements, or screws, are completely installed, by full screwing, inside the seat with which the propeller is provided. With the expression "completely installed" it is meant that the screws reach a position of contact with at least one abutment portion with which is provided the seat wherein they are installed. In so doing, the user inserts and completely screws the movable element inside the seat until it reaches the position of contact with the abutment portion of the seat, so that the movable element reaches a secure and univocal position within the seat and therefore can determine the change in the limit stop of the rotation angular interval of a predetermined value.

It should be noted that the term "screw" is here and hereinafter used to indicate any element provided with at least a shank having a predetermined length and provided with at least a portion, or a head, which can reach at least a position of contact with at least one abutment portion of the seat wherein the screw is installed.

According to one aspect of the present invention, the propeller hub is provided with a first and a second contact surface adapted to reach a first direct or indirect engagement position with a respective first limit stop abutment and a second direct or indirect engagement position of the second contact surface with a corresponding second limit stop abutment. In this case, the angular interval (α) of rotation of the hub with respect to the propeller cylindrical casing is defined by the first and second engagement position.

Furthermore, it should be noted that the at least one seat is preferably formed on the propeller so that the at least one movable element installed inside the same is substantially perpendicular with respect to a plane passing through the rotation axis (A) of the hub.

Preferably, the propeller according to the embodiment just described, comprises two seats for the installation, within each of them, of at least one movable element. In so doing, it is possible to independently adjust the fluid-dynamic blade pitch in the case in which the hub is driven by the drive shaft in a clockwise or counterclockwise direction, generally used to allow navigation in forward and reverse motion.

In fact, the possibility of independently installing two movable elements in the appropriate seats for the modification of the limit stop, respectively for the rotation of the hub in the two rotation directions, allows to adjust with certainty the fluid-dynamic blade pitch for the two navigation modes in a completely independent and accurate way.

The possibility to adjust the fluid-dynamic blade pitch with certainty in the two navigation directions, in forward and reverse motion, following the rotation of the hub with respect to the propeller casing in a clockwise or counterclockwise direction, and vice versa, is particularly advantageous in case in which the propeller blades are provided with a symmetrical profile, and therefore need to be arranged in the same fluid-dynamic pitch for both forward and reverse navigation. Furthermore, the propeller according to the present invention comprises at least one kinematic mechanism coupled to the hub and/or to the propeller casing, and at least one blade, for the regulation of the propeller fluid-dynamic pitch by way of the rotation of the blade/s about its own pivoting axis to the propeller casing. The regulation kinematic mechanism of the fluid-dynamic pitch is driven in the at least one non-zero rotation angular interval (α) of the hub with respect to the propeller cylindrical casing, or vice versa.

A method is also described for adjusting the fluid-dynamic pitch of the propeller blades by way of a propeller briefly described above.

The method comprises the step of installing at least one movable element in the seat or seats to define a desired angular interval α of relative rotation of the hub with respect to the propeller cylindrical casing, or vice versa, and the further step of acting on the adjustment means to change the position of the movable element and therefore the position of the limit stop abutment of the angular interval α, in one or more discrete intervals.

In fact, when a fine and accurate modification of the fluid-dynamic pitch is required, the method comprises the step of displacing the movable element in one or more discrete intervals for the achievement of at least one further position to obtain a desired angular interval α of relative rotation of the hub with respect to the propeller cylindrical casing, or vice versa.

The pitch adjustment method results easier and ensures the arrangement of the blades on the selected pitch, without the need of having to perform a procedure comprising a succession of attempts and tests, as occurs in propellers known in the art, and in particular for the propeller adjustment described for example in DE3901672.

Furthermore, the presence of the adjustment means allows to obtain a fine and accurate adjustment of the fluid-dynamic pitch simply by changing the position of the movable element in one or more discrete intervals that correspond to predetermined positions of the limit stop abutment, allowing to obtain the reliable and accurate modification of pitch and at the same time being very simple and fast.

BRIEF DESCRIPTION OF THE FIGURES

Further characteristics and advantages of the present invention will become more apparent from the following description, given by way of example with reference to the accompanying drawings, wherein.

DETAILED DESCRIPTION OF CHOSEN EMBODIMENTS OF THE PRESENT INVENTION

Figure 1:
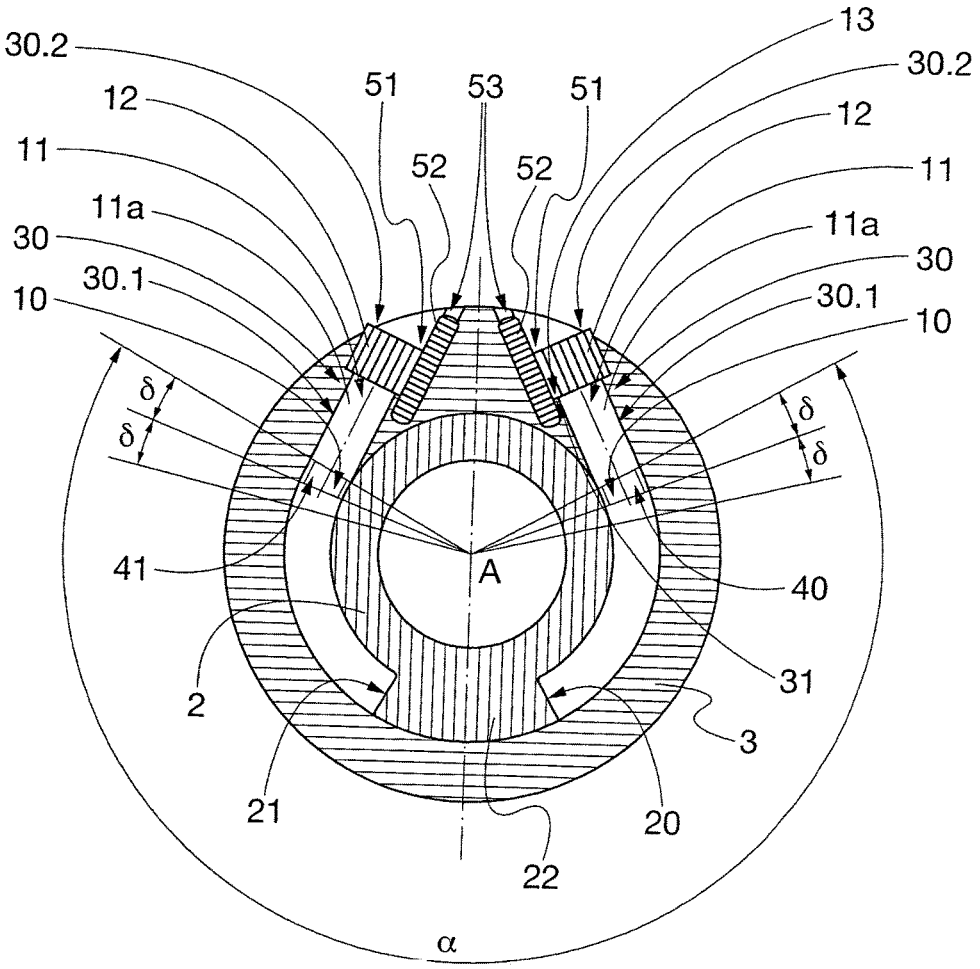
FIG. 1 is a cross-sectional view taken along a plane perpendicular to the longitudinal axis of a hub for use with a propeller (not shown) wherein two movable elements are installed in the hub and are adjustable according to discrete intervals, according to a possible embodiment of the propeller according to the present invention.

FIG. 1 shows a possible embodiment of the propeller according to the present invention, comprising a propeller, preferably for marine use, wherein one or more movable elements are installed, possibly chosen among a plurality of elements available, for the modification of the fluid-dynamic blade pitch by way of the modification of the angle of relative rotation between the hub 2 and the propeller cylindrical casing 3.

Similarly to the propeller described in the document IT1052002, in the name of Massimiliano Bianchi, the propeller according to the present invention comprises a hollow cylindrical casing 3 and a drive shaft driven by an engine, not shown in the figures.

The drive shaft is constrained by way of known means to a hub 2, or the latter may constitute one end of the same drive shaft.

The propeller hub 2 is coaxially coupled to the cylindrical casing 3 so as to allow, as will be better described below, the transmission of the rotary motion from the drive shaft to the cylindrical casing.

Figure 3:
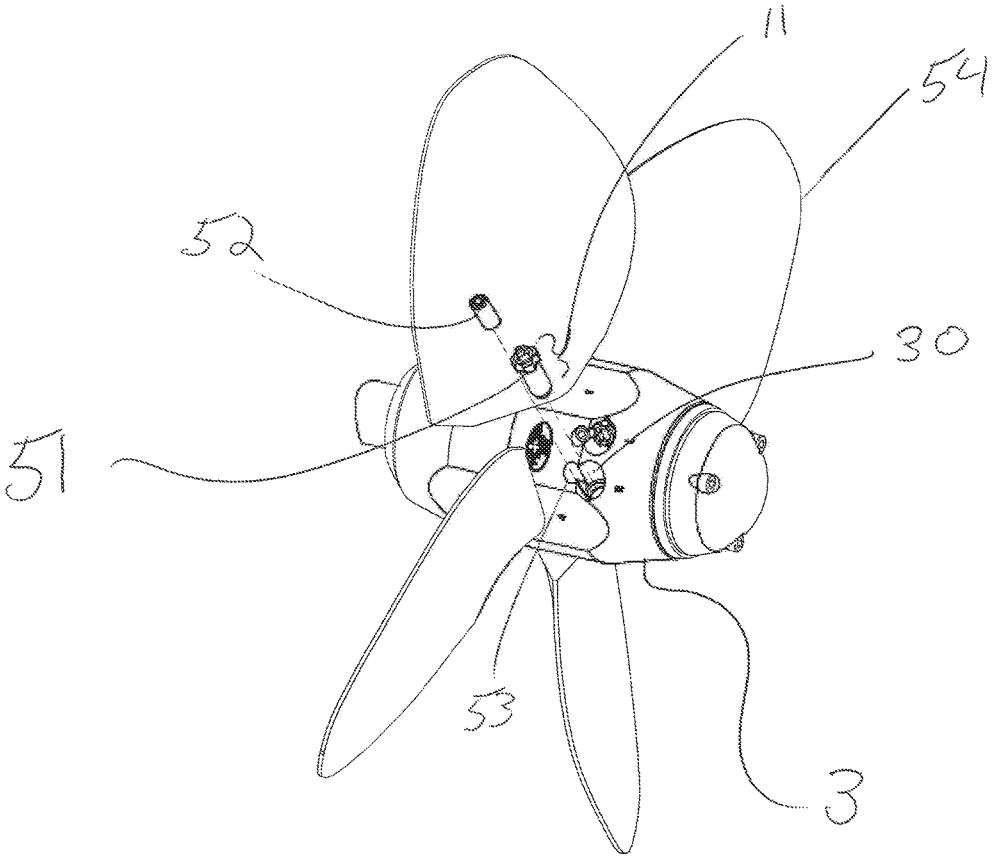
FIG. 3 shows a schematic partial cross-sectional view taken along the axis of rotation A in FIG. 1 of an embodiment of a kinematic mechanism used by the present invention in combination with a propeller.

As shown in FIG. 3, propeller blades 54 are pivoted to the propeller casing 3 so that they can rotate about its own pivoting axis, in other words, the blades 54 may rotate along an axis orthogonal (not labelled) with respect to that defined by the hub 2 of the propeller, which coincides with the advancement direction of the propeller during the forward and backward motion.

As further shown in FIG. 3, the propeller according to the present invention also comprises a kinematic mechanism 60 for transforming the rotary motion of the drive shaft, and therefore of the hub 2 of the propeller coupled there to, with respect to the propeller casing 3, or vice versa, into the rotary motion of each of said blades 54 around its own pivot axis to said propeller casing 3.

More in detail, said mechanism 60 determined the rotation of the blades 54 around its own pivoting axis, thus varying the angle of incidence with respect to the fluid (and therefore the fluid-dynamic pitch), when the drive shaft, and therefore the hub 2, rotates with respect to the propeller cylindrical casing 3 of a non-zero rotation angle, or vice versa.

The kinematic mechanism of transformation of the rotary motion is for example, of the type comprising a frusto-conical toothed pinion 62 integral with the root of each blade 54, i.e. the end of the blade housed within the propeller casing 3.

The propeller hub 2 is provided with a toothed gear integral with a frusto-conical central pinion 64 which permanently meshes the pinions 62 of the respective blades 54, so that the rotation of the central pinion 64 with respect to the propeller cylindrical casing 3 determines the corresponding rotation of the blades 54, about their respective pivotal axes to propeller casing 3, or vice versa. Said rotation of each blade 54 about its axis results in the variation of the relative angle of incidence and therefore the fluid-dynamic pitch of the propeller.

Consequently, the relative rotation of the drive shaft, or of the hub 2, with respect to the propeller cylindrical casing 3, determines the rotation of the blades 54, according to an angle which is obviously a function of the angle of relative rotation between the hub 2 and the propeller cylindrical casing 3.

The kinematic mechanism 60 just described can of course be replaced with equivalent means which, by way of the relative rotation between the drive shaft, and therefore of the hub 2, and the propeller cylindrical casing 3, allow the variation of the fluid-dynamic pitch transforming the rotary motion of the drive shaft in the rotation of the blades 54 around its own pivoting axis, and vice versa.

In fact, the propeller according to the present invention can be equipped with at least one elastic element for the continuous variation of the fluid-dynamic blade pitch during the relative rotation of the hub 2 with respect to the propeller cylindrical casing 3, and vice versa, in the rotation angular interval, as for example described in patent application WO2008/075187, also in the name of the Applicant.

As shown in the accompanying figures, in the propeller assembly according to the present invention, the hub 2 is rotatable with respect to the propeller cylindrical casing 3, or vice versa, for at least one non-zero angular interval α. As said, said angular interval α determines the actuation of the regulation kinematic mechanism of the fluid-dynamic blade pitch. Furthermore, the hub 2 comprises, or is connected to, at least one contact surface 20, 21 movable between at least one direct or indirect disengagement position and at least one direct or indirect engagement position with at least one corresponding abutment 10, 40, 41 which defines at least one limit stop abutment of the angular interval α.

In other words, the rotation of the hub 2 with respect to the propeller cylindrical casing 3 in a non-zero angular interval, determines the variation of the fluid-dynamic pitch of the propeller blades by way of said kinematic mechanism of transformation of the relative rotational movement of the hub 2 with respect to the propeller casing 3, and vice versa, in rotation of each blade around its own pivoting axis to the propeller cylindrical casing 3.

More in detail, the hub 2 comprises, or is connected to, at least one contact surface 20, 21 destined to reach at least an engagement position with at least one abutment 10, 40, 41 which acts as a limit stop for the rotation angular interval of the hub 2 with respect to the propeller casing.

In the embodiment illustrated in the figures, the contact surfaces 20 and 21 of the hub 2 are arranged on a portion 22 of greater diameter of the hub 2, extending externally therefrom.

The hub 2 driven by the drive shaft can freely rotate with respect to the propeller cylindrical casing 3 until the at least one contact surface 20, 21 of the hub 2 reaches at least one engagement position with at least one abutment 10, 40, 41. Preferably the angular interval of relative rotation between the hub 2 and the propeller cylindrical casing 3 is between at least one of the contact surfaces 20 and 21 of the hub 2 and the respective abutment which as mentioned acts as a limit stop of the rotation interval. In other words, the relative rotation between the hub 2 and the cylindrical casing 3 is allowed until reaching the engagement position of one of the contact surfaces 20 and 21 of the hub 2 with a respective limit stop abutment 10, 40, 41.

It has to be noted that the abutment element 10 which acts as a limit stop of the angular rotation of the hub 2 with respect to the casing 3 of the propeller comprises at least a region of at least one movable element 11. The abutment element of the other end of the interval of angular rotation α can comprise a surface 40, 41 of, or integral with, the propeller cylindrical casing 3. In the embodiment illustrated in FIG. 1, the propeller hub 2 is provided with a first and a second contact surface 20 and 21 adapted for reaching respectively a first direct or indirect engagement position with a relative first limit stop abutment 40, integral with the propeller cylindrical casing 3 and corresponding substantially to the lower end of the seat 30, and a second direct or indirect engagement position of the second contact surface 21 with a respective second limit stop abutment 41, integral with the propeller cylindrical casing 3 and corresponding substantially to the lower end of the seat 30. In this case, the angular interval α of rotation of the hub 2 with respect to the propeller cylindrical casing 3 is defined by the first and second engagement position. As will be better seen below, the movable element or elements 11, and in particular the adjusting means 51, 52 of the position in one or more discrete intervals of one or more movable elements 11 of the propeller, allow to change the position of the limit stop abutment 10, which will result in a corresponding and predetermined change in the fluid-dynamic pitch.

The modification of the position of the limit stop abutment 10 is visible in FIG. 1 with reference to the variations of the amplitude of the rotation angle α, indicated by the angular variations δ.

Obviously, as mentioned above, the limit stop abutment of one end of the angular interval α may comprise, in the case in which a single movable element 11 is installed, an abutment surface 40 and 41 with which the propeller cylindrical casing 3 is provided. The first contact surface 20 of the hub 2 is destined to reach the engagement position with the abutment surface 40 when the drive shaft, and therefore the hub 2 of the propeller, is driven in rotation in the counter-clockwise direction.

On the contrary, when the inversion of the rotation direction of the engine is carried out, according to the clockwise direction, the contact surface 21 of the hub 2 reaches the engagement position with the abutment surface 41 integral with the propeller cylindrical casing 3.

The achievement of the engagement position of the hub 2 with the propeller cylindrical casing 3, and in particular of one of the contact surfaces 20 and 21 with the respective abutment, determines the arrangement of the blades, by way of the above mentioned kinematic of motion transmission, on a predetermined fluid-dynamic pitch. It follows that, the presence of movable elements 11, whose position can be varied in a secure and accurate way, in one or more discrete intervals, by way of the abovementioned adjustment means 51, 52 will allow to change in a corresponding manner the position of the limit stop abutment 10 of the angular interval α, which will lead to a secure and accurate change in the fluid-dynamic blade pitch.

In fact, the rotation angular space (angle α) of the hub 2 with respect to the propeller cylindrical casing 3 can be adjusted by way of at least one movable element 11. As mentioned, the limit stop abutment 10 of the angular interval α comprises at least one region of at least one movable element 11 installed in at least a seat 30 with which the propeller is provided.

As shown in FIG. 1, at least one region of the movable element 11, and preferably the end thereof, acts as abutment 10 for the contact surface 20, 21 of the hub 2 by modifying the limit stop of the rotation angular interval of the hub with respect to the propeller cylindrical casing, and vice versa. In fact, once the movable element 11 is installed in the appropriate seat 30 it acts as an abutment 10 for the hub 2, and in particular for at least one of its contact surfaces 20, 21 that reach at least one engagement position with a region of the movable element 11.

According to a possible embodiment the movable element 11 protrudes by a determined length from the seat 30 wherein it is installed so as to determine the amplitude modification of the angle α. The amplitude modification of the angle α is represented in FIG. 1 by the angle δ changes due to changes in position of the movable element 11.

In fact, depending on the position of the movable element 11 installed in the appropriate seat 30 of the propeller, it is possible to obtain a modification of the angular interval of relative rotation of the hub with respect to the propeller casing, and in particular a modification of the limit stop of said angular interval. In particular, the length of the movable element 11 projecting from the lower end of the seat 30, allows to change the position of the limit stop abutment of the angular interval.

In fact, depending on the position of the movable element 11, and in particular the length of the portion projecting from the seat 30, the at least one contact surface 20, 21 integral with the hub 2 will reach the engagement position with the corresponding abutment, i.e. at least a region of the movable element 11 and preferably its end, following the rotation of the hub with respect to the propeller cylindrical casing, or vice versa, in an angular interval of different sizes in relation to the modification of the limit stop of said angular interval determined by the position the movable element 11.

According to a preferred embodiment the movable element 11 has rod-like shape, and as will be described in more detail below, preferably has at least one threaded portion adapted to cooperate with at least one corresponding threaded portion of the seat 30 wherein it is installed.

Figure 2:
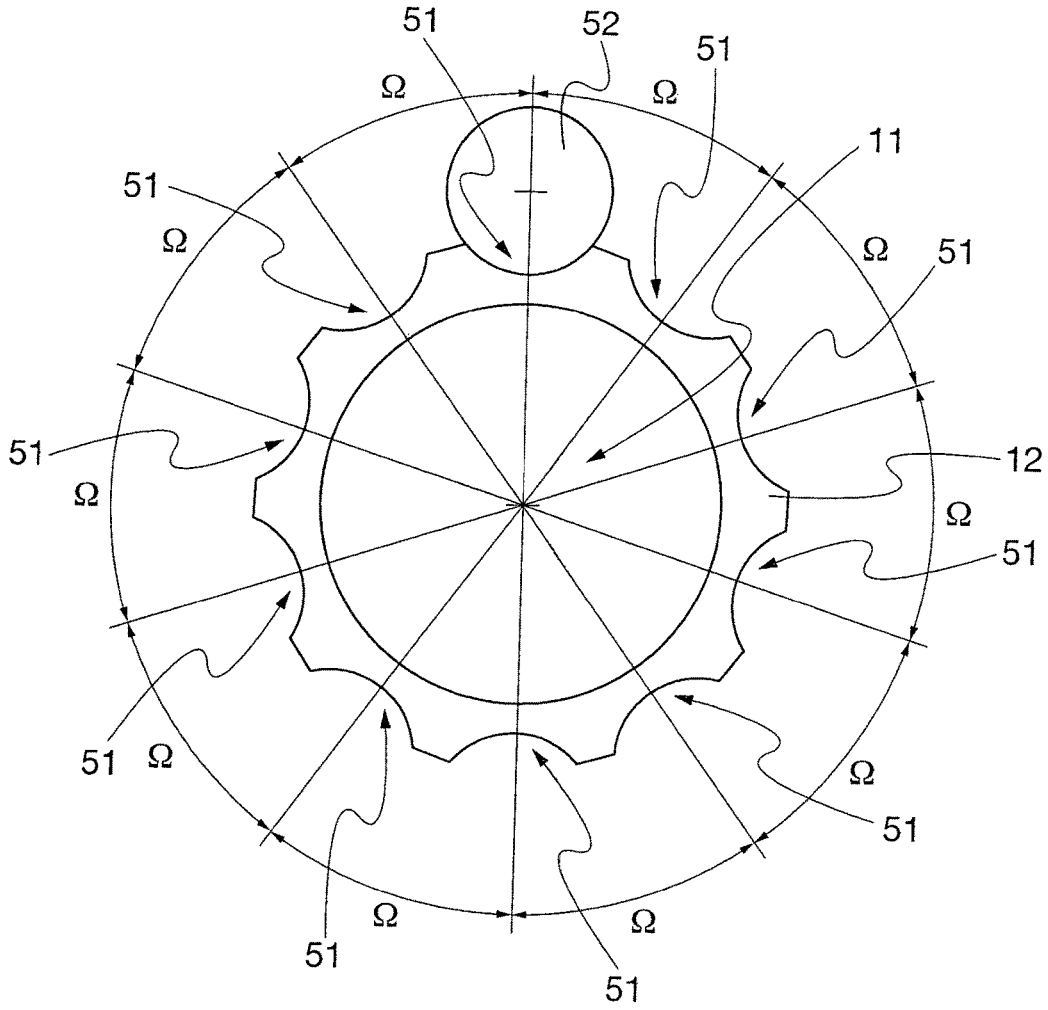
FIG. 2 is an enlarged view of the movable element and of the adjustment means of a possible embodiment of the propeller according to the present invention.

Advantageously, as can be more clearly seen in the detailed view of FIG. 2, the propeller according to the present invention comprises adjustment means 51, 52 of the position of the movable element 11 with respect to the propeller cylindrical casing so as to modify the position of the limit stop abutment 10 of the angular interval α. In particular, the adjustment means 51, 52 with which the propeller is provided allow to obtain a modification of the discrete intervals type, in other words, it is possible to change the position of the movable element 11 and hence that of the limit stop abutment 10 at predetermined distinct positions (i.e. already known distinct position). More in detail, the adjustment means 51, 52 define two or more distinct positions by means of one or more discrete intervals of adjustment.

In the sectional view of FIG. 1 the angular variation δ due to the modification of the position of the movable element 11 is shown, which represents the modification of the limit stop abutment 10 of the angular rotation α of the hub 2 with respect to the propeller cylindrical casing 3, and vice versa, which comprises at least one region of the movable element 11, and as mentioned, preferably, the end of the movable element 11 installed in the seat 30.

According to a preferred embodiment of the present invention, the at least one movable element 11 comprises at least one threaded portion adapted to cooperate with at least a threaded portion of the seat 30 wherein the movable element is installed. The cooperation between the threaded portions of the movable element 11 and the seat 30 allows to change the position of the movable element 11 and therefore of the limit stop abutment of the angular interval α.

In fact, as is known, by imparting a rotation to the threaded movable element 11 a consequent axial displacement will be obtained, allowing in fact the change in the position of the limit stop abutment 10 which, as mentioned, preferably corresponds to the end of the movable element 11.

More in detail, thereby imparting a rotational motion to the movable threaded element 11, the consequent axial displacement resulting therefrom will determine the change in the length of the projecting portion of the movable element 11 from the seat 30.

According to a possible embodiment, the movable element or elements 11 have substantially the shape of a screw and comprise at least one shank 11*a* and at least one clamping head 12 which can reach a contact position with at least one abutment portion 31 of the seat 30 of the cylindrical casing 3 of the propeller 1.

It should be noted that the term "screw" is used herein to indicate any element, for example, rods, pins, bolts, provided with at least a shank 11*a* having a predetermined length and provided with at least a portion, or a head 12 that can reach at least a contact position with at least one abutment portion 31 of the seat 30 within which the screw is installed.

More in detail, in the embodiment shown in FIG. 1, the seat 30 comprises an abutment portion 31, intended to contact, preferably the lower surface 13 of the head 12 of the movable element 11.

It should also be noted that the movable elements 11 are provided with a suitably shaped portion adapted to be engaged by a tool, or even manually by the user, to allow its installation in the seat 30 with which the propeller is provided. Preferably, the head 12 of the movable element 11 is provided with an actuating hexagonal portion, or the like, adapted to be temporarily engaged by a tool having a complementary shape which allows the user to screw and unscrew the movable element 11 in the seat 30.

In the embodiment shown in the figures, the seat 30 within which at least one movable element 11 is installed, is passing inside the cylindrical casing 3, so that at least part of the movable element 11, and in particular its shank 11*a*, is at least in part projecting inside the propeller cylindrical casing 3 so as to act as a limit stop abutment for the hub 2 and then adjust the rotation angle of the hub with respect to the propeller cylindrical casing, and vice versa.

In the embodiment shown in the figures, the seat 30 has a cylindrical shape and has a portion 30.1 of reduced diameter intended to allow passage to its own internal portion of the shank 11*a* of the movable element 11, and a second portion 30.2 of greater diameter with respect to that of the portion 30.1, which is intended to accommodate the head 12 of the movable element 11. The difference in diameter between the first and the second portions 30.1 and 30.2 of the seat 30 determines the formation of the abutment surface 31, intended to come into contact with the lower surface 13 of the head 12 of the movable element 11.

Obviously, other embodiments of the seat 30 can be obtained.

Preferably, the seat 30 is formed on the propeller, and in particular on the cylindrical casing 3 thereof, so that the movable element 11 installed internally is substantially perpendicular with respect to a plane passing through the rotation axis A of the hub 2.

As has been said, in the embodiment shown in the figures, the hub 2 is provided with two contact surfaces 20 and 21 with a respective abutment 10 which acts as a limit stop of the angular interval of relative rotation between these two propeller elements.

According to this embodiment the propeller is provided with at least one seat 30 for the installation, within each of them, of at least one movable element 11.

In so doing, it is possible to independently adjust the fluid-dynamic blade pitch in the case wherein the hub 2 is driven by the drive shaft, to which it is connected, in a clockwise or counterclockwise direction, generally used to allow both forward and reverse navigation.

In fact, the possibility of independently installing two movable elements 11 in the dedicated seats 30 for the modification of the limit stop 10, respectively for the rotation of the hub in the clockwise and counterclockwise rotation directions, allows to adjust with certainty the fluid-dynamic blade pitch for the two navigation modes, in an independent manner.

As has been said, the adjustment means 51, 52 of the propeller according to the present invention allow to change the position of the threaded movable element 11 in one or more discrete intervals.

In fact, as will become clear hereinafter, the adjustment means 51, 52 allow the rotation of the movable threaded element and the consequent axial displacement by a given interval that determines a modification of the predetermined position of the limit stop abutment 10, and therefore of the rotation angular interval α. It follows that the propeller according to the present invention allows to obtain a certain and accurate adjustment of the fluid-dynamic blade pitch by simply adjusting in one or more discrete intervals the position of the movable element 11.

The adjustment means 51, 52 allow to arrange the threaded movable element in two or more distinct positions as a result of its rotation and the consequent axial displacement which determines the modification of two or more values of the fluid-dynamic pitch.

According to a possible embodiment the adjustment means comprise at least one block element 52 which engages at least partially the propeller cylindrical casing 3 and at least partially the movable element 11 in different positions.

More in detail, the block element or elements 52 engage at least partially with the movable element 11 and at least partially with the propeller cylindrical casing 3 to determine the blocking in two or more positions defined by one or more discrete intervals.

The engagement with the movable element 11 in different positions allows to arrange the movable element 11 in different predetermined positions with respect to the propeller cylindrical casing which determine different distinct and predetermined positions of the limit stop abutment 10.

The adjustment means of the propeller according to the present invention comprises at least one groove 51 provided at the surface of the movable element 11, preferably in correspondence to its outer surface.

Preferably the groove or the grooves 51 are arranged parallel with respect to the axial displacement direction of the movable threaded element 11 consequentially to its rotation in the corresponding seat 30.

Advantageously, the adjustment means comprise two or more grooves 51 spaced from each other by one or more angular intervals Ω for the definition of one or more adjusting discrete intervals of the position of the movable element 11. As will be seen in more detail below, the rotation of the movable threaded element 11 and the shift from one groove to another determines the adjustment of the movable element from one position to another, according to one or more predetermined displacement discrete intervals.

It should be noted that advantageously, the discrete intervals of the positions wherein the movable element 11 is adjustable are defined by the grooves 51 and by their spacing, represented in FIG. 2 by the angular intervals Ω.

In particular, the block element or elements 52 cooperate with the grooves 51 to determine the change in the position of the movable element 11 and therefore the position of the limit stop abutment 10 of the angular interval α, according to one or more discrete intervals.

In fact, as can be seen in FIG. 2, the block element 52 engages at least partially with at least part of one of the grooves 51 of the movable element 11, and at least partially with the propeller cylindrical casing 3.

In detail, the propeller cylindrical casing comprises at least one seat 53, wherein at least part of the block element 52 is engaged.

As a result, by rotating the threaded movable element 11 for moving from one groove 51 to another it is possible to change by a certain amount the axial displacement of the same, causing a corresponding change in the position of the limit stop abutment 10.

In particular, it is possible to divide the axial displacement of the movable element 11, which determines different positions of the limit stop abutment 10 in one or more intervals, by dividing and adjusting the rotation of the movable element 11 in corresponding positions defined by one or more discrete intervals.

In fact, depending on the pitch of the thread used for the movable element 11 and for the seat 30, a specific rotation imposed to the movable element will result in a corresponding axial displacement.

The presence of different grooves 51 allows to divide the rotation in multiple discrete intervals which correspond to a division of the axial displacement of the movable element 11.

In the embodiment shown in FIG. 2, the movable element comprises ten grooves 51 that allow the modification of the position at discrete intervals between the different positions wherein the groove 51 is located in correspondence of the seat 53 of the propeller cylindrical casing wherein the block element 52 at least partially engages. Starting from the position shown in FIG. 2, the rotation of the movable element 11 will determine, for example, the positioning of the next groove 51 in correspondence of the seat 53 of the propeller cylindrical casing. The rotation of the angular interval comprised between the two grooves will result in a corresponding axial displacement of the movable element 11, which will result in a change in the position of the limit stop abutment 10.

Obviously, by rotating the movable element by a greater interval will result in a corresponding axial displacement of the movable element and therefore a modification of the corresponding limit stop abutment 10 of the angular interval α.

Obviously the discrete intervals of adjustment defined by the angular intervals Ω between one groove and the next may be constant or have a different amplitude depending on the requirements.

In other words, the coupling of threaded parts used for the movable element 11 and the corresponding seat 30 wherein it is installed is such as to define the axial displacement in relation to its rotation. Therefrom it is known that for a complete rotation of the movable element a determined axial displacement will be obtained that will determine the displacement of the angular interval limit stop and therefore a modification of the pitch by a specific amount.

Thanks to the adjustment means 51, 52, and to the possibility to move in one or more discrete intervals the position of the movable element it is possible to divide the rotation, and therefore the axial displacement of the movable element, with the consequent obtainment of a subdivision of the reachable pitch values as a result of the movable element displacement.

For example if a full rotation of the movable element provides a pitch change of one degree, ten equally spaced grooves 51 will allow the modification of the position of the movable element in more discrete intervals of a tenth of a degree each. Obviously, providing a different number of grooves 51 it is possible to divide the movable element displacement and therefore the consequent modification of the fluid-dynamic pitch in different small and predetermined intervals.

According to one aspect of the present invention, the user is provided with movable threaded elements having different lengths which define a given fluid-dynamic pitch if installed in the seat 30.

Subsequently, when the boat user wishes to change the imposed fluid-dynamic pitch, he proceeds to the rotation of the movable element of one or more intervals, arranging the desired groove 51 in correspondence with the block element 52 by determining the modification of the fluid-dynamic pitch. Advantageously, the user is provided with a table that, depending on the movable element installed, indicates how much the pitch will vary by rotating the movable element 11 by one or more intervals Ω.

It should be noted that the block element 52 of the adjustment means, according to a possible embodiment must be removed from the engagement position with the movable element 11 and with the propeller cylindrical casing to allow the movable element displacement in a further position and subsequently reinstalled to block the movable element in said position.

According to a possible embodiment, the block element 52 of the adjustment means is rod-shaped for engaging at least partially a groove 51 and the seat 53 of the propeller cylindrical casing.

In the embodiment shown in the figures, the block element 52 comprises also at least one threaded portion adapted to cooperate with at least one threaded portion obtained in correspondence of the grooves 51 of the movable element and/or on the propeller cylindrical casing and in particular in the seat 53.

According to one aspect of the present invention, each movable element 11 is provided with at least one shank 11*a* which determines the achievement of a predetermined fluid-dynamic pitch once installed in the seat 30, in relation to the length of its portion projecting from the lower end of the seat 30. As said, the adjustment means will determine a fine adjustment of the pitch simply by changing the position of the movable element 11, which will determine an axial displacement of the movable element and therefore a change in the length of the protruding portion of the shank 11*a* from the lower end of the seat 30. It should be noted that the propeller according to the present invention may comprise a plurality of movable elements 11 having different lengths from each other. In so doing, the movable elements will each define a determined fluid-dynamic pitch and adjustment means will determine a fine modification of the pitch obtained with each movable element.

The user will then have full availability of various movable elements 11 having different lengths in order to accurately adjust the fluid-dynamic blade pitch by installing the movable element in the dedicated seat and adjusting in a fine and accurate way the pitch by means of the adjustment means in the vicinity of the pitch reached by the movable element installed in the seat, or for the fine modification into discrete intervals between the pitch value reachable by a movable element and the pitch value reachable by another movable element.

The movable elements supplied to the user may be such as to provide a wide range of modification values of the pitch and the adjustment means 51, 52 allow to divide the range of values of the fluid-dynamic pitch reachable by an element and by another element of discrete quantity even very small and in a very accurate way.

In the case wherein the user intends to change the pitch of a value not reachable by the movable element 11 installed in the seat and with the fine adjustment implemented by the adjustment means 51, 52, he may advantageously install a movable element of a different length which may also perform a fine and accurate adjustment in the vicinity of the fluid-dynamic pitch reachable by the same.

Preferably, the movable elements 11 are installed completely inside the appropriate seat 30 with which the propeller is provided, and reach a contact position with at least one abutment portion 31 of the seat 30. In other words the movable elements 11 are completely screwed into the seat 30 of the propeller and the modification of their position by way of the adjustment means 51, 52 is done by loosening the movable element 11 into the different discrete intervals.

In so doing, the user inserts the movable element 11 inside the seat 30 until it reaches the contact position with the abutment portion 31 of the seat, so that the screw reaches a certain and unique position within the seat 30, and therefore can determine the modification of the angular rotation limit stop of predetermined amplitude. Then, in case a fine adjustment of the pitch is needed to be performed, the movable element is unscrewed so as to cause a retraction axial displacement which determines an increase of the rotation angle α. As described above, the adjustment means 51, 52 allow to obtain said displacement with the consequent modification of the fluid-dynamic pitch by discrete intervals that correspond to accurate and predetermined fluid-dynamic pitch modifications.

Now, the steps for the adjusting method of the fluid-dynamic blade pitch by means of a propeller according to the present invention will be described.

As stated, the fluid-dynamic blade pitch is adjusted by way of one or more movable elements 11 which are installed in the propeller so as to change in an accurate and precise way the rotation angular interval of the hub 2 with respect to the propeller cylindrical casing 3, and vice versa, by changing the position of the limit stop abutment 10 of said angular interval.

In other words, depending on the position of the movable element 11, the hub 2, and in particular, its contact surface 20, 21, will reach the engagement position with the abutment, which is preferably constituted by one end of the movable element 11 extending from the lower end of the seat 30, by changing the rotation angular interval of the hub 2 with respect to the propeller cylindrical casing 3, and consequently the fluid-dynamic blade pitch.

Advantageously the propeller according to the present invention also comprises adjustment means 51, 52, in one or more discrete intervals, of the position of the movable element 11.

The method for adjusting the fluid-dynamic pitch comprises the step of installing at least one movable element 11 in the seat or seats 30 to define a desired angular interval α of relative rotation of said hub 2 with respect to said propeller cylindrical casing 3, or vice versa; and the further step of operating the adjustment means 51, 52 to change the position of the movable element 11 and therefore the position of the limit stop abutment 10 of the angle α, in one or more discrete intervals.

In fact, when it is needed to perform a fine and accurate modification of the fluid-dynamic pitch, the method comprises the step of displacing the movable element 11 in one or more discrete intervals for the achievement of at least one further position to obtain a desired angular interval α of relative rotation of the hub 2 with respect to the propeller cylindrical casing 3, or vice versa. In particular, in the embodiment shown in the figures, once a movable element at least partially threaded 11 is installed in the seat 30, the user who wishes to change the pitch thus obtained proceeds to change the position of the movable element 11 by way of its rotation.

As said, according to one aspect of the present invention, the movable element 11 is completely installed within the seat 30 until reaching the contact with the abutment portion 31 of the seat 30. Said position allows to arrange the blades on a predetermined fluid-dynamic pitch by the user, according to the length of the shank 11*a* of the installed movable element.

From said position, the user can proceed with the fine and accurate modification of the fluid-dynamic pitch causing the rotation, in the unscrewing direction from the abutment position with the portion 31 of the movable element. Said rotation determines a modification of the position of the limit stop abutment 11 due to the retraction of the protruding portion of the movable element with respect to the lower end of the seat 30.

As said, the displacement occurs in one or more discrete intervals which involve a certain and predetermined modification of the pitch. Essentially the user will rotate the movable element so as to bring the movable element in a different position with respect to the previous one and will proceed to the installation of the block element 52 of the adjustment means in said position. In general the method step involves installing at feast one block element 52 of the adjustment means for the at least partial engagement with the movable element 11 and at least partially with the propeller cylindrical casing 3.

When the user wishes to further modify the fluid-dynamic pitch, the temporary removal of the block element 52 has to be actuated to be able to move the movable element 11 by at least one discrete interval in at least one further position. By reaching the desired position, which will result in the achievement of the desired reliable and accurate fluid-dynamic pitch, the user will proceed to install again the block element 52 of the adjustment means for engaging at least partially the movable element 11 and at least partially the propeller cylindrical casing 3.

As previously mentioned, the discrete interval or intervals for moving said at least one movable element 11 are defined by two or more grooves 51 of the adjustment means spaced from each other by one or more angular intervals Ω. In fact, the user will rotate the movable threaded element by an angle such as to arrange the desired groove in correspondence of the seat 53 of the propeller cylindrical casing wherein the block element 52 is at least partially inserted.

Advantageously, as previously mentioned, the possibility of modifying the position of the movable element in more discrete intervals, by way of a number of grooves which can be varied according to the necessity, allows to obtain a fine and accurate modification of the fluid-dynamic pitch.

It should be noted that the propeller according to the present invention may comprise a plurality of movable elements 11 having different lengths between one another. In doing so, the movable elements will each define a determined fluid-dynamic pitch and the adjustment means 51, 52 will determine a fine change of the pitch.

The user will then have full availability of various movable elements 11 having different lengths in order to accurately adjust the fluid-dynamic blade pitch by installing the movable element in the appropriate seat and by adjusting in a fine and accurate way the pitch by way of the adjustment means in the surrounding of the pitch reached by the movable element installed in the seat, or for the fine modification into discrete intervals between the pitch value reachable by a movable element and the value of the pitch reachable with another movable element.

Furthermore, it should be noted that according to a possible embodiment, one or more inserts, for example in the form of calibrated rods (not shown in the figures), can be installed between the hub 2 and the propeller cylindrical casing 3, and in particular, between at least one contact surface 20, 21 of the hub 2 and the relative limit stop abutment 10, within the angular interval (α) of relative rotation of the hub with respect to the propeller cylindrical casing, or vice versa, to carry out the adjustment.

The inclusion of one or more rods in the rotation interval α allows for example to carry out large variations (in the order of tens of degrees) of the fluid-dynamic pitch, and therefore of the angular rotation of the hub 2 with respect to the propeller casing 3, and vice versa.

Obviously, depending on the thickness (bulk) of the rods installed it is possible to vary in a different way the angular rotation interval, allowing a different modification of the fluid-dynamic blade pitch.

The invention claimed is:

1. A propeller comprising:

at least one propeller cylindrical casing, a hub, adapted to be coupled to an engine, and mounted inside said propeller cylindrical casing, at least one blade rotatable pivoted to said propeller cylindrical casing, said hub being rotatable with respect to said propeller cylindrical casing, or vice versa, for an at least one non-zero angular interval (α) for the adjustment of the fluid-dynamic pitch of said at least one blade, said hub comprising at least one contact surface movable between at least one direct or indirect disengagement position, and at least one direct or indirect engagement position with an at least one relative limit stop abutment of said at least one non-zero angular interval (α), and said limit stop abutment comprising at least one region of at least one movable element arranged in an at least one seat of said propeller cylindrical casing for the modification of the position of said limit stop abutment of said at least one non-zero interval (α), wherein said at least one movable element is at least partially threaded and installed in said at least one seat comprising at least one threaded portion the region of the movable element acting as at least one limit stop abutment of said at least one angular interval (α) comprises at least the end of said at least one movable element, the rotation with the consequent axial displacement of said threaded movable element in said at least one threaded seat modifying the position of said limit stop abutment of said at least one non-zero angular interval (α), said hub further comprising adjustment means for adjusting the position of said at least one movable element, in one or more discrete intervals, for modifying the position of said at least one limit stop abutment of said at least one non-zero angular interval (α), wherein said adjustment means of the position in one or more discrete intervals of said at least one movable element comprises two or more grooves provided on at least part of the surface of said at least one movable element spaced from each other by one or more angular intervals (Ω) for the definition of said one or more discrete intervals of position adjustment of said at least one movable element, wherein said adjustment means further comprises at least one block element engaging at least partially with said at least one groove of said movable element and at least partially with a seat of said propeller cylindrical casing, wherein the two or more grooves spaced from each other by one or more angular intervals (Ω) provides a division of the rotation and of the axial displacement of the movable element, with a correspondent subdivision of the obtained fluid dynamic pitch values as a function of the movable element displacement, the rotation of the movable element of one or more intervals (Ω) with the arrangement of a predetermined groove in correspondence with the block element provides a predetermined modification of the fluid-dynamic pitch.

2. The propeller according to claim 1, wherein said adjustment means of the position, in one or more discrete intervals, of said at least one movable element define two or more positions of said limit stop abutment.

3. The propeller according to claim 1, wherein said at least one groove is parallel to the axial displacement direction of said threaded movable element as a result of its rotation in said at least one seat at least partially threaded.

4. The propeller according to claim 1, wherein said at least one block element is substantially rod-shaped.

5. The propeller according to claim 1, wherein said at least one movable element at least partially threaded is a screw provided with at least a shank.

6. A method for the adjustment of the fluid-dynamic pitch of a propeller, comprising:

the step of providing a propeller comprising at least one propeller cylindrical casing, a hub, adapted to be coupled to an engine, and mounted inside said propeller cylindrical casing, at least one blade rotatable pivoted to said propeller cylindrical casing, said hub being rotatable with respect to said propeller cylindrical casing, or vice versa, for an at least one non-zero angular interval ($\alpha$) for the adjustment of the fluid-dynamic pitch of said at least one blade, said hub comprising at least one contact surface movable between at least one direct or indirect disengagement position, and at least one direct or indirect engagement position with an at least one relative limit stop abutment of said at least one non-zero angular interval ($\alpha$), and said limit stop abutment comprising at least one region of at least one movable element arranged in an at least one seat of said propeller cylindrical casing for the modification of the position of said limit stop abutment of said at least one non-zero angular interval ($\alpha$), wherein said at least one movable element is at least partially threaded and installed in said at least one seat comprising at least one threaded portion the region of the movable element acting as at least one limit stop abutment of said at least one angular interval ($\alpha$) comprises at least the end of said at least one movable element, the rotation with the consequent axial displacement of said threaded movable element in said at least one threaded seat modifying the position of said limit stop abutment of said at least one non-zero angular interval ($\alpha$), said hub further comprising adjustment means for adjusting the position of said at least one movable element, in one or more discrete intervals, for modifying the position of said at least one limit stop abutment of said at least one non-zero angular interval ($\alpha$), wherein said adjustment means of the position in one or more discrete intervals of said at least one movable element comprises two or more grooves provided on at least part of the surface of said at least one movable element spaced from each other by one or more angular intervals ($\Omega$) for the definition of said one or more discrete intervals of position adjustment of said at least one movable element, and wherein said adjustment means further comprises at least one block element engaging at least partially with said at least one groove of said movable element and at least partially with a seat of said propeller cylindrical casing, wherein the two or more grooves spaced from each other by one or more angular intervals ($\Omega$) provides a division of the rotation and of the axial displacement of the movable element, with a correspondent subdivision of the obtained fluid dynamic pitch values as a function of the movable element displacement, the rotation of the movable element of one or more intervals ($\Omega$) with the arrangement of a predetermined groove in correspondence with the block element provides a predetermined modification of the fluid-dynamic pitch, the step of installing said at least one movable element in said at least one seat, said at least one movable element being shaped to define a desired non-zero angular interval ($\alpha$) of relative rotation of said hub with respect to said propeller cylindrical casing, or vice versa; and the step of operating said adjustment means to adjust the position of said movable element, and therefore the position of said at least one limit stop abutment of said at least one non-zero angular interval ($\alpha$), in said one or more discrete intervals.

7. The method according to claim 6, further comprising the step of moving said at least one movable element in said one or more discrete intervals for reaching at least one further position to obtain at least one desired non-zero angular interval ($\alpha$) of relative rotation of said hub with respect to said propeller cylindrical casing, or vice versa.

8. The method according to claim 6, further comprising the step of installing said at least one block element of said adjustment means for the at least partial engagement with said movable element and the at least partial engagement with said propeller cylindrical casing.

9. The method according to claim 8, further comprising the step of removing said at least one block element of said adjustment means, and the step of moving said at least one movable element for at least one discrete interval in at least one further position, and the step of reinstalling said block element of said adjustment means for engaging at least partially said movable element and at least partially said propeller cylindrical casing.

10. The method according to claim 8, wherein said at least one block element engages at least partially at least one groove obtained on at least part of the surface of said at least one movable element.

11. The method according to claim 6, wherein said one or more discrete intervals for displacement of said at least one movable element are defined by two or more grooves of said adjustment means spaced from each other by one or more angular intervals ($\Omega$), for the definition of said one or more discrete intervals of the adjustment of the position of said at least one movable element.

12. The propeller according to claim 4, wherein said at least one block element further comprises at least one threaded portion.

13. A propeller comprising:

at least one propeller cylindrical casing, a hub, adapted to be coupled to an engine, and mounted inside said propeller cylindrical casing, at least one blade rotatable pivoted to said propeller cylindrical casing, said hub being rotatable with respect to said propeller cylindrical casing, or vice versa, for an at least one non-zero angular interval ($\alpha$) for the adjustment of the fluid-dynamic pitch of said at least one blade, said hub comprising at least one contact surface movable between at least one direct or indirect disengagement position, and at least one direct or indirect engagement position with an at least one relative limit stop abutment of said at least one non-zero angular interval (α), and said limit stop abutment comprising at least one region of at least one movable element arranged in an at least one seat of said propeller cylindrical casing for the modification of the position of said limit stop abutment of said at least one non-zero angular interval (α), wherein said at least one movable element is at least partially threaded and installed in said at least one seat comprising at least one threaded portion the region of the movable element acting as at least one limit stop abutment of said at least one angular interval (α) comprises at least the end of said at least one movable element, the rotation with the consequent axial displacement of said threaded movable element in said at least one threaded seat modifying the position of said limit stop abutment of said at least one non-zero angular interval (α), said hub further comprising adjustment means for adjusting the position of said at least one movable element, in one or more discrete intervals, for modifying the position of said at least one limit stop abutment of said at least one non-zero angular interval (α), wherein said adjustment means of the position in one or more discrete intervals of said at least one movable element comprises two or more grooves provided on at least part of the surface of said at least one movable element spaced from each other by one or more angular intervals (Ω) for the definition of said one or more discrete intervals of position adjustment of said at least one movable element, wherein said adjustment means further comprises at least one block element substantially rod-shaped with at lest one threaded portion, the block element engaging at least partially with said at least one groove of said movable element and at least partially with a seat of said propeller cylindrical casing, wherein the two or more grooves spaced from each other by one or more angular intervals (Ω) provides a division of the rotation and of the axial displacement of the movable element, with a correspondent subdivision of the obtained fluid dynamic pitch values as a function of the movable element displacement, the rotation of the movable element of one or more intervals (Ω) with the arrangement of a predetermined groove in correspondence with the block element provides a predetermined modification of the fluid-dynamic pitch.

14. A method for the adjustment of the fluid-dynamic pitch of a propeller, comprising:

the step of providing a propeller comprising at least one propeller cylindrical casing, a hub, adapted to be coupled to an engine, and mounted inside said propeller cylindrical casing, at least one blade rotatable pivoted to said propeller cylindrical casing, said hub being rotatable with respect to said propeller cylindrical casing, or vice versa, for an at least one non-zero angular interval (α) for the adjustment of the fluid-dynamic pitch of said at least one blade, said hub comprising at least one contact surface movable between at least one direct or indirect disengagement position, and at least one direct or indirect engagement position with an at least one relative limit stop abutment of said at least one non-zero angular interval (α), and said limit stop abutment comprising at least one region of at least one movable element arranged in an at least one seat of said propeller cylindrical casing for the modification of the position of said limit stop abutment of said at least one non-zero angular interval (α), wherein said at least one movable element is at least partially threaded and installed in said at least one seat comprising at least one threaded portion the region of the movable element acting as at least one limit stop abutment of said at least one angular interval (α) comprises at least the end of said at least one movable element, the rotation with the consequent axial displacement of said threaded movable element in said at least one threaded seat modifying the position of said limit stop abutment of said at least one non-zero angular interval (α), said hub further comprising adjustment means for adjusting the position of said at least one movable element, in one or more discrete intervals, for modifying the position of said at least one limit stop abutment of said at least one non-zero angular interval (α), wherein said adjustment means of the position in one or more discrete intervals of said at least one movable element comprises two or more grooves provided on at least part of the surface of said at least one movable element spaced from each other by one or more angular intervals (Ω) for the definition of said one or more discrete intervals of position adjustment of said at least one movable element, and wherein said adjustment means further comprises at least one block element engaging at least partially with said at least one groove of said movable element and at least partially with a seat of said propeller cylindrical casing, wherein the two or more grooves spaced from each other by one or more angular intervals (Ω) provides a division of the rotation and of the axial displacement of the movable element, with a correspondent subdivision of the obtained fluid dynamic pitch values as a function of the movable element displacement, the rotation of the movable element of one or more intervals (Ω) with the arrangement of a predetermined groove in correspondence with the block element provides a predetermined modification of the fluid-dynamic pitch;

the step of installing said at least one movable element in said at least one seat, said at least one movable element being shaped to define a desired non-zero angular interval (α) of relative rotation of said hub with respect to said propeller cylindrical casing, or vice versa, wherein the movable element is installed completely inside the seat of said propeller cylindrical casing and reaches a contact position with at least one abutment portion of the seat; and the step of operating said adjustment means to adjust the position of said movable element, and therefore the position of said at least one limit stop abutment of said at least one non-zero angular interval (α), in said one or more discrete intervals defined by two or more grooves of the movable element spaced from each other by one or more angular intervals Ω, wherein from said position in which the movable elements is installed completely inside the seat, the movable element is rotated in the unscrewing direction from the abutment position with the portion of the movable element such as to arrange the desired groove of the movable element in correspondence of the seat of the propeller cylindrical casing wherein the block element is at least partially inserted.

* * * * *